US006227634B1

(12) United States Patent
Cittadini et al.

(10) Patent No.: US 6,227,634 B1
(45) Date of Patent: May 8, 2001

(54) "GASKET FOR REFRIGERATORS WITH A PROFILED OUTER DOOR"

(75) Inventors: Paolo Cittadini, Luvinate; Pier Paolo Ferrante, Cuvio, both of (IT)

(73) Assignee: Industrie Ilpea S.p.A., Malgesso (IT)

( * ) Notice: Subject to any disclaimer, the term of this patent is extended or adjusted under 35 U.S.C. 154(b) by 0 days.

(21) Appl. No.: 09/245,725

(22) Filed: Feb. 8, 1999

(30) Foreign Application Priority Data

Nov. 5, 1998 (IT) ..... MI98A2406

(51) Int. Cl.[7] ..... A47B 96/00

(52) U.S. Cl. ..... 312/296; 277/630; 277/637; 277/645; 49/478.1; 49/489.1

(58) Field of Search ..... 277/630, 637, 277/640, 645, 648, 649, 921; 49/478.1, 489.1; 312/296, 405

(56) References Cited

U.S. PATENT DOCUMENTS 3,137,900 * 6/1964 Carbury ..... 49/478.1
5,916,076 * 6/1999 Cittandini et al. ..... 49/478.1 X
6,058,657 * 5/2000 Merla ..... 49/478.1

* cited by examiner

*Primary Examiner*—Anthony Knight
*Assistant Examiner*—Karlena D. Schwing
(74) *Attorney, Agent, or Firm*—Oblon, Spivak, McClelland, Maier & Neustadt, P.C.

(57) ABSTRACT

A gasket made of a plastic material for refrigerator chests, including an inner door and an outer door, rigidly connected to each other by a foamed material injected in the hollow space between them for insulating purposes, in which the inner door is profiled along one or more sides with a groove is profiled alone one or more sides with a groove next to an extremity thereof overlaying the outer door, wherein the groove functions as a seat to receive an appropriate fastener for the gasket and the latter is fitted with a bellows-type section made of a soft plastic material capable of providing a closing seal between the inner door and the chest, and a base from which the fastener extends to the inner door, the gasket base being made of a rigid plastic material shaped by co-extrusion with the soft plastic material of the bellows-type portion and presents a substantially horizontal, flat or slightly curved configuration in the portion where the base overlays the extremity of the inner door, while presenting a substantially oblique or vertical configuration in the extremity, and wherein the portion of the base is externally overlaid, on the same side of the outer door, by a layer of soft material coextruded with the rigid material of the base, from which a sealing element extends so as to operatively rest against the outer door, the soft layer forming a portion of the lateral wall of the bellows-type portion.

11 Claims, 8 Drawing Sheets

"GASKET FOR REFRIGERATORS WITH A PROFILED OUTER DOOR"

BACKGROUND OF THE INVENTION

In the industrial branch of refrigerator profiles equipped with a magnetic sealing gasket, sealing systems of a type such as described in the U.S. Pat. No. 4,167,759 and in the European patent 319.087 by the same Applicant are known.

These systems have the common characteristic of assembling, manually or in an automated manner, a rigid profile fitted with a soft gasket co-extruded with the same, an inner door shell on one side and an outer door on the other, and of producing, after the assembly, a foamed material in the hollow space formed between the inner and outer door in order to achieve the thermal insulation of the same.

One of the drawbacks arising in such sealing systems is that in order to produce the foaming material inside an appropriate mold the soft part of the gasket is subjected to a squashing action, which may, in the event of an anomalous positioning inside the foaming mold, even produce a permanent deformation of the mentioned gasket.

On the other hand, different sealing systems have recently been developed, where the need of having a rigid profile of a rather complex geometric shape to allow supporting the soft sealing element on one side and to achieve the coupling of the inner and outer door as well as to fit an alternative gasket on the opposite side has been eliminated.

This has become possible by configuring the same outer door with a groove, generally arranged along the perimeter and capable of functioning as a seat to receive a soft gasket.

The system radically differs from the one discussed above in reference to the patents by the same Applicant, due to the fact that it is in this case possible to arrange for an inner/outer door assembly by executing the thermally insulating foaming step inside the hollow space formed between them prior to installing the gasket.

In other words, this system first produces a complete door, meaning a fully assembled and foamed-out door leading to the additional effect of holding the inner and outer doors permanently coupled to each other, and subsequently provides for mounting the soft gasket by a fastener element, for instance an anchor or leg capable of penetrating and latching by interference into the perimeter hollow with which the outer door has been molded.

A gasket installed according to a technology of this kind is shown in FIG. 1 of the drawings attached to this description.

With reference to this FIG. 1, a gasket of the known art is indicated by G and operatively assumes the configuration shown by a full line.

In this operating condition, the gasket G is installed across an anchoring leg E inside a groove 10 provided along the perimeter of an outer door 30. The latter is assembled with the plate of an inner door 30, where the inner door 30 and the outer door 30 are held together by a thermally insulating roamed material used to fill the hollow space formed between them.

This gasket is produced from a single type of soft plastic material and fitted at its upper end with a seat for a magnetic material M.

As can be seen, in the lower part a fastening element E projects from a base D produced with a thickness greater than that of the remainder of the gasket, so as to attain an adequate stability against the stresses induced by the door's opening and closing motions, and therefore by the traction of the magnet on the part of the refrigerator chest.

These stresses basically result into two forces, as shown in FIG. 1 by the vectors A and B which are basically acting vertically to each other.

The effect of a continuous application of such forces A and B on the gasket G is to generate some deformations, as shown in a simplified manner by a dashed line in FIG. 1.

As can be seen, these deformations are substantially due to a lifting action of the base D in the outer lateral area of the system, accompanied by a corresponding lifting action of the sealing strip C, which should in an operating position fit against the outer door (30) so as to achieve a lateral seal.

The deformation caused by the gasket's stretching under the effect of the magnetic traction is considerable. In order to attempt reducing this deformation, the only possible solution is to try to increase the thickness of the base D, which adversely affects the production costs.

Moreover, such a solution is incapable of preventing the deformations generated in this manner. The magnetic attraction also results in a constant lifting action of the anchoring leg E inside the outer door's groove 10. This entails the need to size this fastening leg E with a considerable thickness, which again affects the costs and at any rate fails to prevent the constant shifting action of the leg inside the groove 10, and consequently even runs the risk that such an anchoring leg may sooner or later jump off its seat.

SUMMARY OF THE INVENTION

These problems are solved by a gasket according to this invention, which consists of a gasket 1 made of a plastic material for refrigerator chests and the like, equipped with an outer door 30 and an inner door (31) rigidly connected to each other by injecting a foamed material into the hollow space formed between them for thermal insulating purposes, of a kind in which said outer door 30 is profiled along one or more sides with a groove 10 in the area next to its extremity 13 overlaying said inner door 31, where said groove 10 functions as a seat to receive an appropriate fastener 11 of said gasket, where the latter presents a bellows-type portion (20) made of a soft plastic material capable of producing a sealing gasket between the door and the refrigerator chest 32, and a base 12 from which said fastener 11 extends, characterized in that said gasket base 12 is made of a rigid plastic material produced by co-extrusion with the said soft plastic material of the bellows-type portion 20, and presents a substantially horizontal, flat or slightly curved configuration in the portion 14 in which said base overlays the extremity 13 of said outer door, while presenting a substantially oblique or vertical, flat or slightly curved configuration in the portion of the extremity 15, where said portion 15 of said base is externally overlaid, on the same side as the outer door 30, by a layer 16 of soft material co-extruded with the rigid material of said base, from which a sealing element 17 is extended so as to operatively rest against said outer door 30, while the mentioned soft layer 16 belongs to the lateral wall of said bellows-type portion 20.

BRIEF DESCRIPTION OF THE DRAWINGS

In order to provide a better understanding of the characteristics and advantages of the invention as substantially described above, a number of examples of a practical execution are given below, with reference to the FIGS. from 2 to 8 of the attached drawings. With reference to the mentioned drawings.

DETAILED DESCRIPTION OF THE PREFERRED EMBODIMENTS

Figure 2:
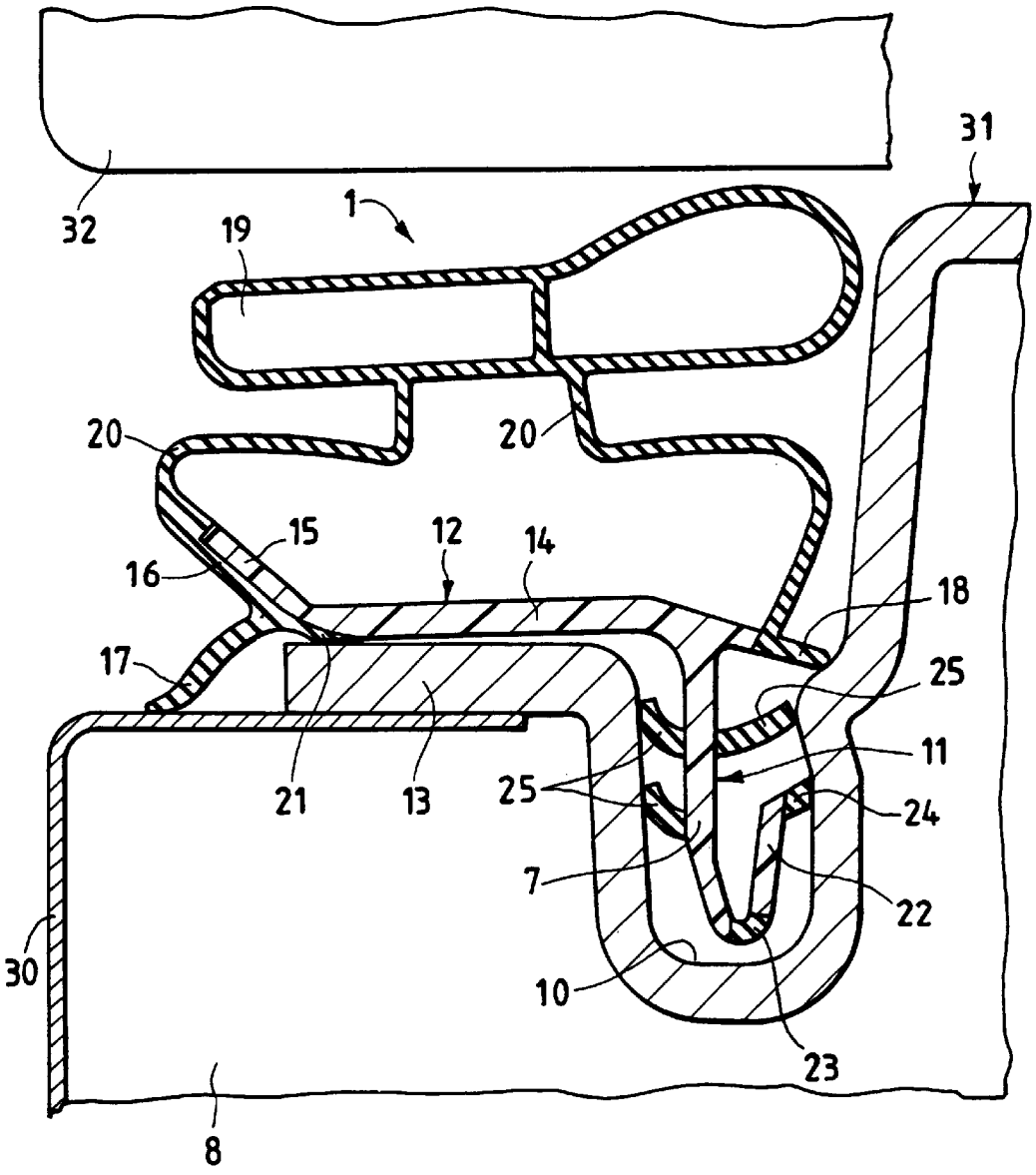
FIG. 2 shows a gasket according to the invention operatively mounted on a door of the refrigerator, in a cross-sectional view.

With reference to FIG. 2 of the attached drawings, a gasket 1 according to the invention is mounted on one door of the refrigerator and/or freezer in which the plate of an inner door 31 and an outer door 30 are rigidly connected to each other by the foam 8 of a thermally insulating material injected into the hollow space formed between them.

For this purpose the inner door 31 is profiled along one or more sides, for instance preferably along its entire perimeter, with a groove 10 profiled in the area next to its extremity 13 which overlays the mentioned plate of the outer door 30. The groove 10 functions as a seat to receive the mentioned gasket.

The gasket 1 is made of a co-extruded plastic material. It is in fact constituted of a bellows-type portion 20 made of a soft plastic material, so as to achieve a closing seal between the door and the refrigerator chest 32. For this purpose the gasket ends in its upper part with a seat 19 to hold the magnetic insert.

In its lower part the gasket 1 presents a base 12 from which a fastener 11 extends. The gasket base 12 is made of a rigid plastic material shaped by co-extrusion with the mentioned soft plastic material of the bellows-type portion 20, and presents a substantially horizontal configuration in its central portion, which in the case of FIG. 1 turns out to have slightly a curved profile in the direction of the inner door 31.

This central portion of the base in which the same overlays the extremity 13 of the outer door is indicated by the reference number 14 in the gasket of FIG. 2. The terminal outer part of the same base is separated from this portion 14 of the base 12. In the example of FIG. 2, this terminal part presents an oblique configuration turned in the direction of the bellows-type portion 20 of the gasket. This outer wall of the bellows-type area and this portion of the extremity 15 of the base 12 are in fact co-extruded, and the co-extruded area of the example shown in FIG. 2 extends even over a short stretch of the portion 14 of the base 12, so that in the contact area between the latter and the extremity 13 of the outer door 31 the gasket rests against the same outer door along a stretch of soft gasket 21. The layer 16 of soft material co-extruded with the rigid material of said external base, on the same side as that of the inner door 30, projects with a lip 17 having a sealing action and rests against the mentioned inner door 31, as seen in FIG. 2.

The opposite side of the base in the co-extruded area, between the bellows-type portion 20 and the base 12, also provides for an extension of the soft material along the sealing lip 18 which rests against the outer door 31.

In its lower part the base 12 of the gasket 1 is equipped with a fastener 11 capable of coupling to the seat 10 provided in the inner door 31.

In the case of FIG. 2, this fastener 11 is for instance constituted of a rigid leg 7 capable of entering the groove 10 and latching-up inside the same by interfering elements constituted of a flexible flap 22 or a rigid material capable of flexing in the presence of a soft co-extruded elbow 23, designed to form a seal on the outer door thanks to some soft sealing strips 24 and 25 capable of deforming by interference and of functioning as a seal against the edge of the outer door 31.

Figure 3:
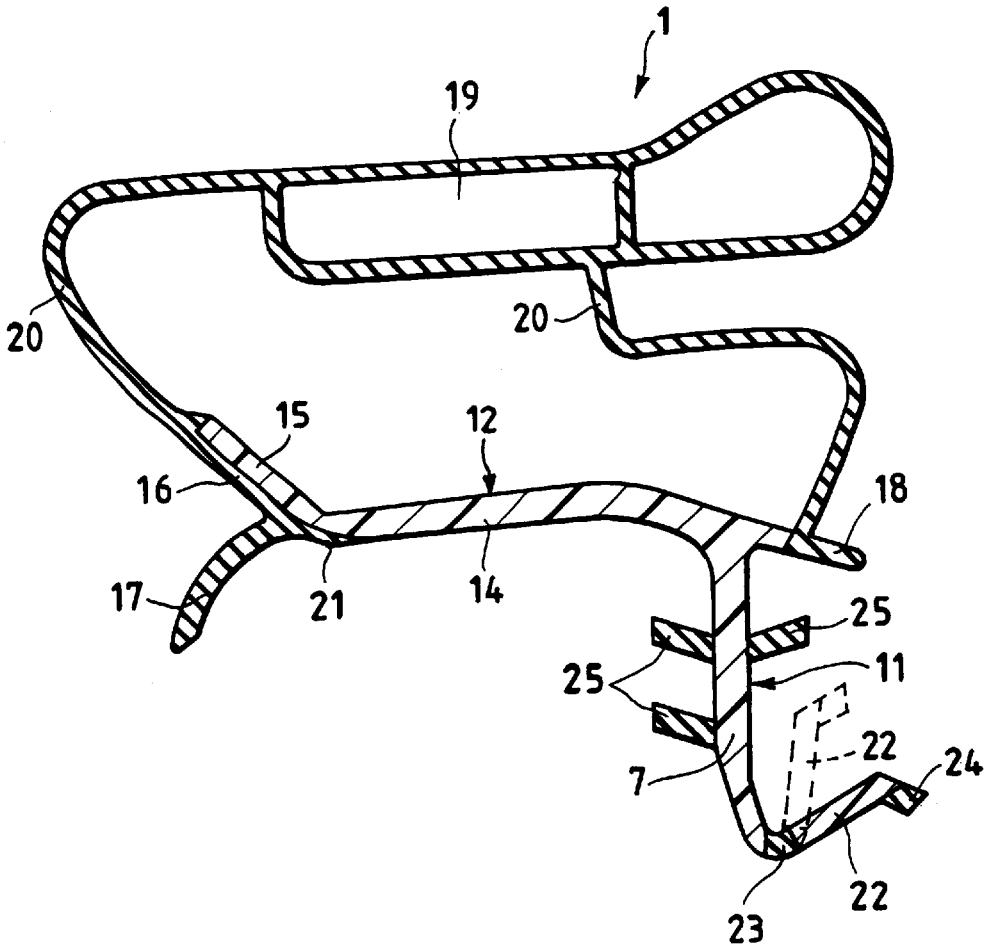
FIGS. 3, 4, 5, and 6 show nominal sections of gaskets according to the invention, based on an equal number of variants.
Figure 4:
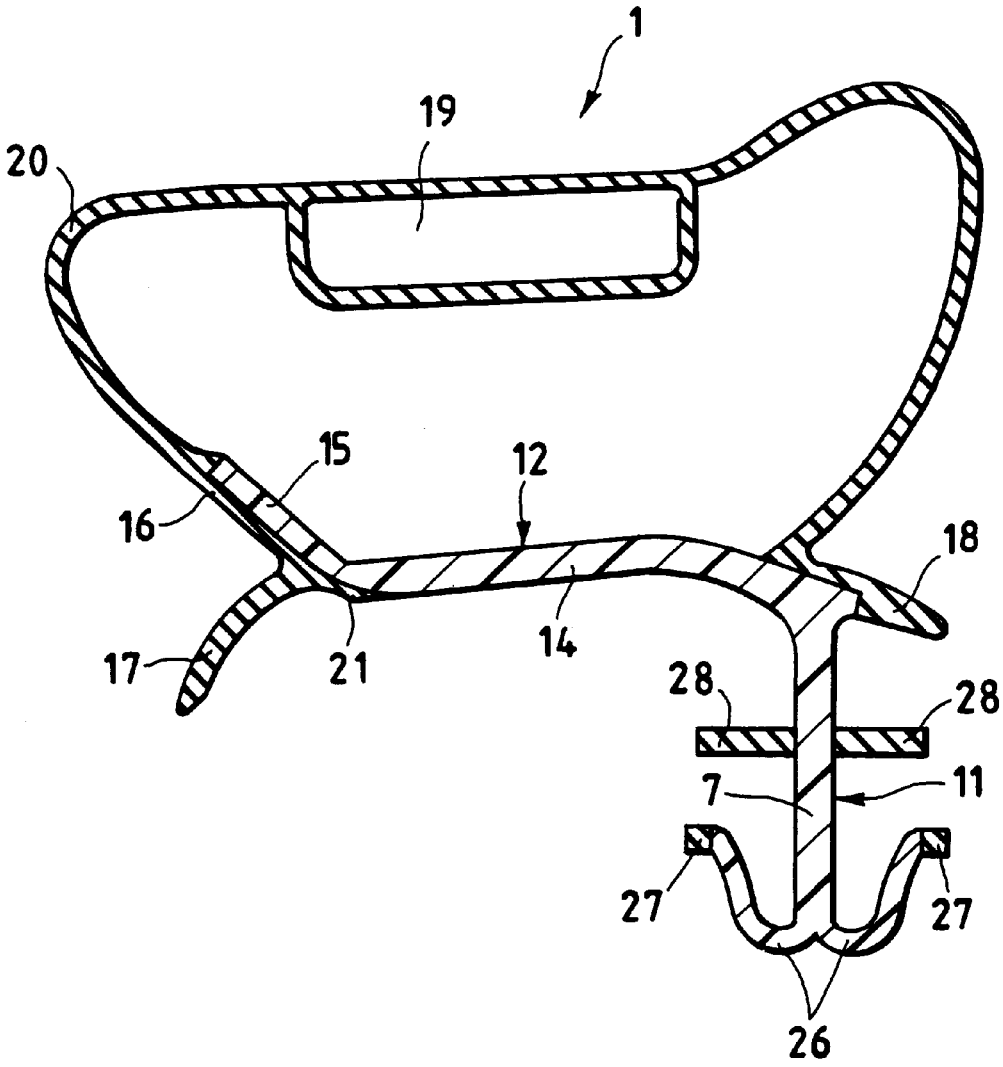
Figure 5:
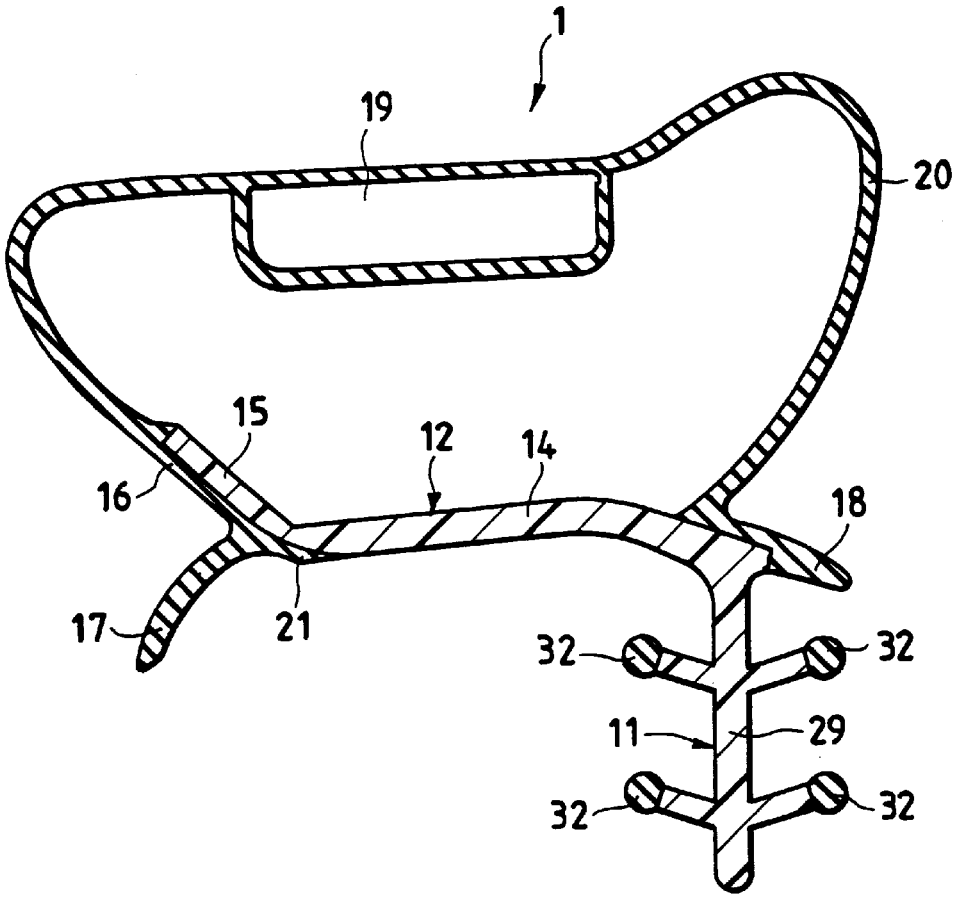

The FIGS. 3, 4 and 5 of the attached drawings illustrate variants of the gasket shown in FIG. 2, both as refers to the configuration of the soft bellows-type portion 20 as to the fastener 11. It can in particular be seen that the fastener in FIG. 4 is constituted of a rigid anchor, whose lower part is fitted with two flexible flaps 26 ending in a sealing strip 27. The center of the same anchor is also fitted with two soft sealing strips 28 which lock into the groove 10 of the outer door, again by deformation and interference.

The variants shown in FIGS. 3, 4 and 5 also show that the base 12 can in its portion 14 also have a slightly curved configuration to different extents, just as the co-extruded areas between the mentioned base 12 and its terminal portion 15 may also have different configurations.

Still another different configuration of the fastening leg 11 is shown in FIG. 5, in which it continues to be a substantially rigid element 29 carrying soft sealing strips 32.

Figure 6:
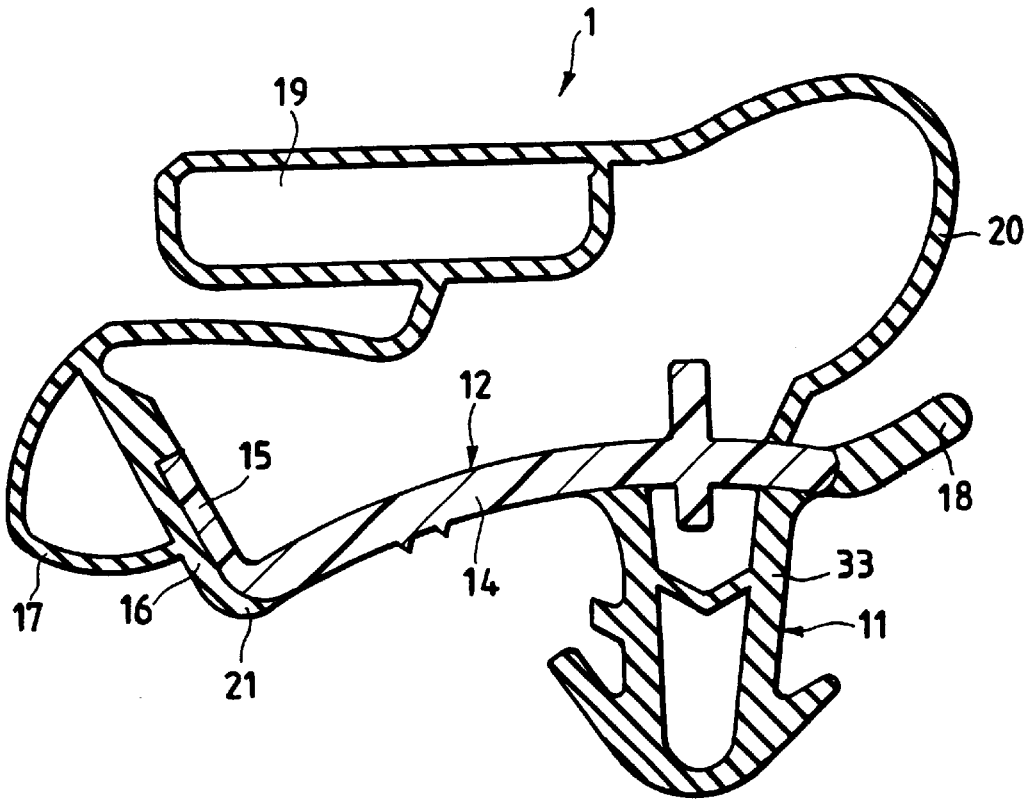
Figure 7:
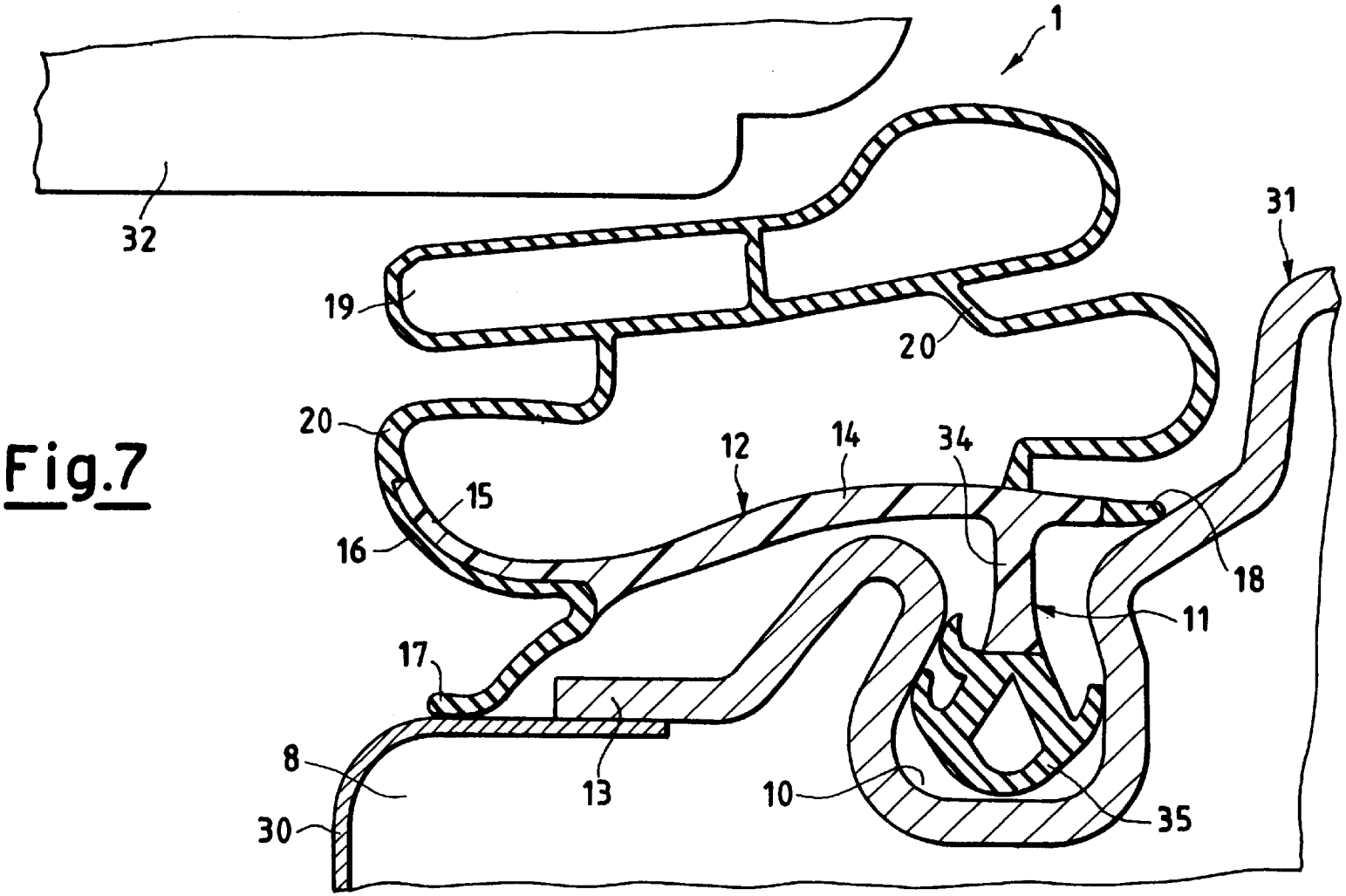
FIGS. 7 and 8 show further variants of the gaskets according to the invention, again operatively mounted on the refrigerator and in cross-sectional views.
Figure 8:
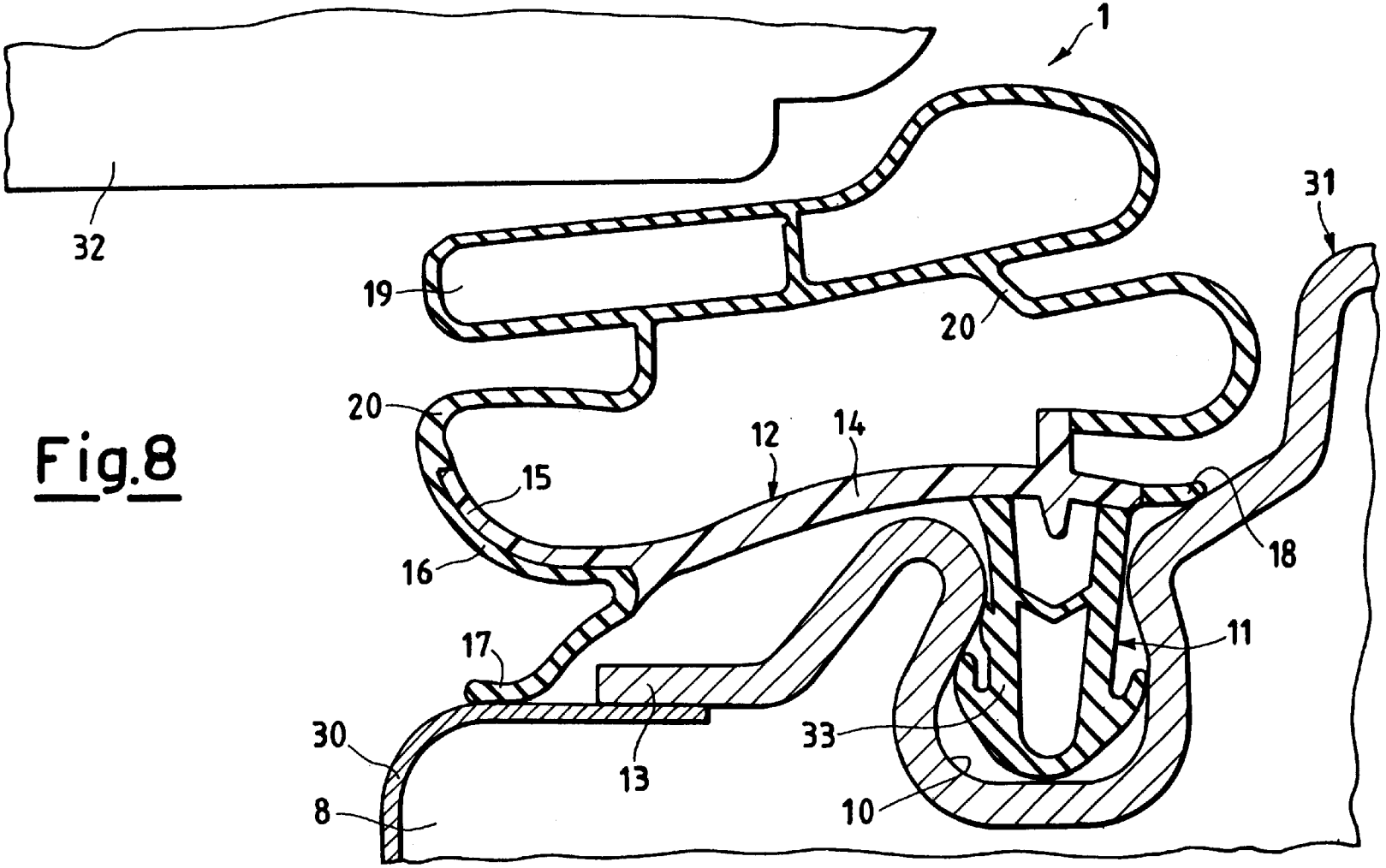

Further variants of the gasket according to the invention are shown in the FIGS. 6 to 8, which show in particular that the fastening element 11 is entirely constituted of a soft material, just like the leg 33 of FIGS. 6 and 8, or the soft-rigid co-extrusion 33–35 shown in FIG. 7.

In particular, the FIGS. 7 and 8 also show a different configuration of the outer door according to a more complex geometry, which at any rate provides a groove 10 capable of receiving the fastening element 11 of the gasket according to the invention. In particular, the variant of FIG. 6 shows that the sealing element 17 destined to operatively rest against the plate of the outer door 30 is not a lip as in the foregoing figures, but a tubular element particularly suitable for those executions of the door plate which extend toward the chest in a shoulder-like configuration.

Figure 1:
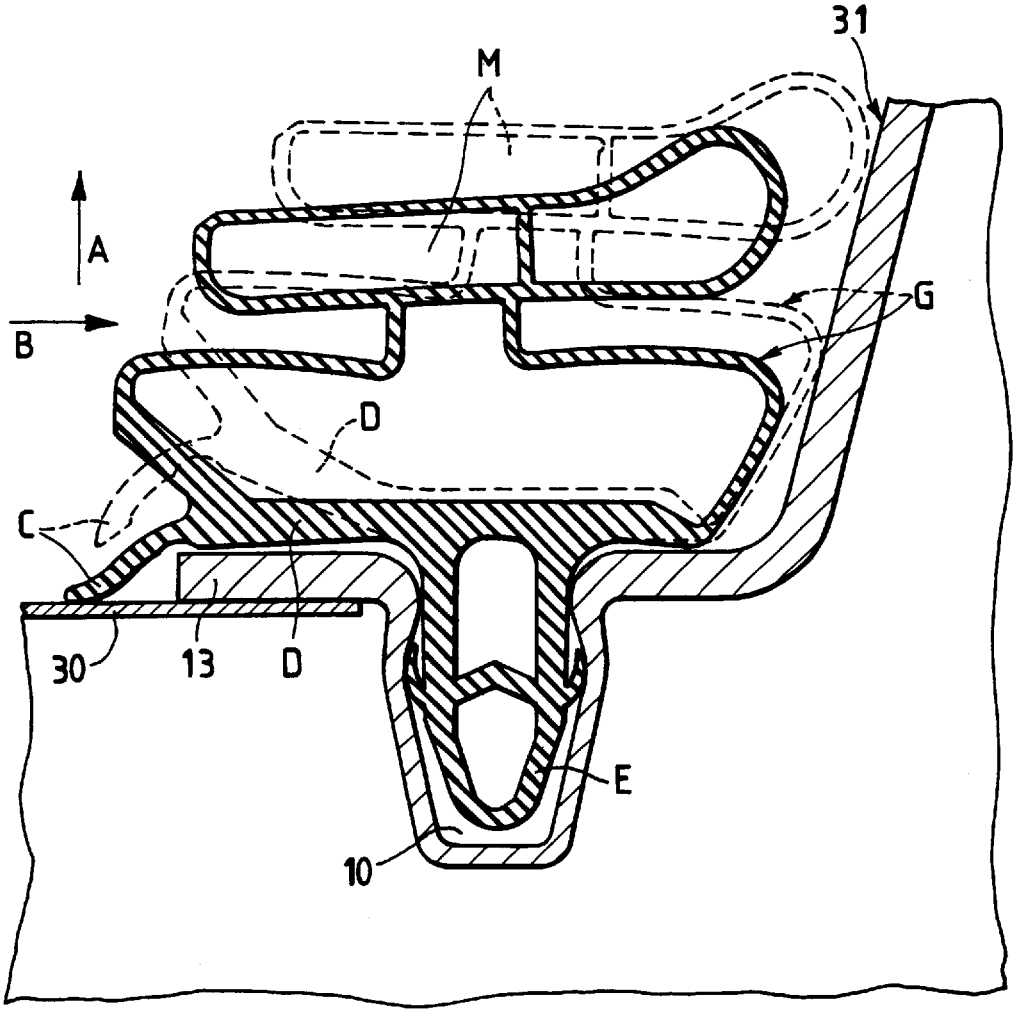
Fig.1 PRIOR ART
FIG. 1 shows an installed gasket of the known art.

Regardless of the various forms of execution described above, the gasket according to this invention is capable of effectively solving the technical problem described in the beginning, as it provides for a rigid base 12 along a substantially horizontal central portion of a flat or slightly curved shape as shown in the examples of the figures, which projects a substantially oblique or vertical external portion of a flat or slightly curved shape capable of avoiding the typical deformations shown for example in FIG. 1 with respect to the known art, meaning deformations caused by the lifting stresses of the base or of its external extremity, as well as a lateral instability of the gasket, thanks to the fact that it provides a practically undeformable corresponding portion in the gasket.

This solution of the technical problem is above all accompanied by the further advantage of being able to provide thin layers in the rigid part of the gasket, thus facilitating even an automatic installation of the gasket and minimizing production costs.

This advantage is even more evident where it is desired to use a rigid recycled or regenerated material, which is entirely feasible because the rigid material is practically hidden from sight once the gasket is operatively mounted on the refrigerator, so that any color divergencies go undetected.

According to the invention, the fact of providing for a rigid base 12 extending on one side over an inclined or vertical plane 15 and on the other side over a the vertical fastener 11 with respect to the substantially horizontal plane of the base 12 generates a dimensional stability of the gasket and a rigidity which opposes the sagging typical of the soft gaskets made by the known art shown in FIG. 1.

This rigidity of the gasket according to the invention allows to handle the gasket itself by mechanical means, thereby making it possible to automate a few phases of its production as well as its application and installation on the door of a refrigerator.

The rigid base 12 and its extensions 11 and 15 also allow producing a few notches or other reference systems useful for reducing the longitudinal dimensional tolerances of the gasket, which are typically in the range of 4–6 mm for the soft gasket of FIG. 1. This reduction of the dimensional tolerances according to the invention may reach 1–2 mm, which represents a considerable advantage.

According to the invention, the fastening element 11 is further capable of latching itself into the seat 10 of the outer door in a stable manner, better than a gasket solely made of a soft material based on the known art.

What is claimed is:

1. A gasket made of a soft material for refrigerator chests, comprising:

an inner door and an outer door rigidly connected to each other by injecting a foamed material into the hollow space formed between said inner and outer doors for thermal insulating purposes before coupling, wherein said inner door has a groove in an area next to an extremity thereof overlaying said outer door and wherein said groove comprises a seat;

a fastener for said gasket, said fastener being located in said seat and including a bellows-type portion made of a soft plastic material for producing a tight seal between the door and the chest, said gasket including a base from which said fastener extends, wherein said base of said gasket comprises a rigid plastic material shaped by co-extrusion with said soft plastic material of said bellows-type portion, and is substantially flat where said base overlays the extremity of said inner door, said base having an extremity with one of a substantially oblique configuration and a vertical configuration in a portion of said base wherein a layer of soft material is co-extruded with the rigid material from said base, and wherein one of said oblique configuration and said vertical configuration is externally overlaid, on a same side of the inner door, by said layer made of a soft material co-extruded with the rigid material of said base;

a sealing element projecting from said co-extruded layer and contacting said outer door, wherein said extruded layer comprises a lateral wall of said bellows-type portion.

2. A gasket according to claim 1, wherein said sealing element comprises a lip.

3. A gasket according to claim 1, wherein said sealing element has a tubular profile.

4. A gasket according to claim 1, wherein said layer of soft-co-extruded material extends to said portion of said base overlaying said extremity of said inner door which is in contact with said extremity of said inner door.

5. A gasket according to claim 1, wherein the terminal portion of said base opposite said groove is obliquely shaped, and a corresponding lateral wall of the bellows-type portion is obliquely shaped.

6. A gasket according to claim 1, wherein said terminal portion of said base opposite said groove extends vertically, and a corresponding lateral wall of the bellows-type portion extends vertically vertical.

7. A gasket according to claim 1, wherein said fastening element comprises soft material co-extruded with said base.

8. A gasket according to claim 1, wherein said fastening element comprises a rigid material.

9. A gasket according to claim 1, wherein said fastener comprises a semi-flexible material.

10. A gasket according to claim 1, wherein said fastener extends vertically from said base.

11. A gasket according to claim 1, wherein said fastener comprises:

a plurality of interlocking elements positioned in the groove; and a rigid leg which extends into said groove and being secured therein by said plurality of interlocking elements and having a semi-flexible flap with a soft co-extruded elbow which is flexible and which forms a seal on the door liner along with the soft sealing strips.

* * * * *